US007880681B2

(12) United States Patent
Rentz et al.

(10) Patent No.: US 7,880,681 B2
(45) Date of Patent: Feb. 1, 2011

(54) ANTENNA WITH DUAL BAND LUMPED ELEMENT IMPEDANCE MATCHING

(75) Inventors: Mark L. Rentz, Torrance, CA (US); Osvaldo Salazar, Baldwin Park, CA (US)

(73) Assignee: Navcom Technology, Inc., Torrance, CA (US)

( * ) Notice: Subject to any disclaimer, the term of this patent is extended or adjusted under 35 U.S.C. 154(b) by 319 days.

(21) Appl. No.: 12/037,908

(22) Filed: Feb. 26, 2008

(65) Prior Publication Data

US 2009/0213020 A1 Aug. 27, 2009

(51) Int. Cl.
*H01Q 1/00* (2006.01)

(52) U.S. Cl. ..... 343/722; 343/852; 343/860

(58) Field of Classification Search ..... 343/722, 343/852, 860

See application file for complete search history.

(56) References Cited

U.S. PATENT DOCUMENTS

| | | | | |
|---|---|---|---|---|
| 4,725,848 | A | 2/1988 | Honda | 343/895 |
| 4,731,877 | A | 3/1988 | Moon | 455/340 |
| 4,850,034 | A * | 7/1989 | Campbell | 455/74 |
| 4,951,006 | A | 8/1990 | Cohen | 331/74 |
| 5,375,256 | A * | 12/1994 | Yokoyama et al. | 455/80 |
| 5,594,454 | A | 1/1997 | Devereux et al. | 342/357 |
| 6,856,287 | B2 | 2/2005 | Rao et al. | 343/700 |
| 6,919,851 | B2 | 7/2005 | Rogers et al. | 343/749 |
| 7,176,845 | B2 | 2/2007 | Fabrega-Sanchez et al. | 343/850 |
| 7,180,467 | B2 | 2/2007 | Fabrega-Sanchez et al. | 343/861 |
| 7,190,322 | B2 | 3/2007 | Apostolos et al. | 343/841 |
| 7,274,338 | B2 | 9/2007 | Ozkar et al. | 343/793 |
| 7,274,340 | B2 * | 9/2007 | Ozden et al. | 343/860 |
| 7,330,153 | B2 | 2/2008 | Rentz | 343/700 |
| 2005/0272387 | A1 | 12/2005 | Cowley et al. | 455/180.3 |
| 2006/0044196 | A1 | 3/2006 | Grant et al. | 343/713 |
| 2007/0205945 | A1 | 9/2007 | Tatarnikov et al. | 343/700 |
| 2007/0236400 | A1 | 10/2007 | Rentz et al. | 343/753 |
| 2008/0186140 | A1 * | 8/2008 | Kuwako et al. | 340/10.1 |

FOREIGN PATENT DOCUMENTS

EP 1445872 A3 9/2004

OTHER PUBLICATIONS

International Search Report for International Application No. PCT/US2009/035270, mailed Aug. 17, 2009.

* cited by examiner

*Primary Examiner*—Tho G Phan
(74) *Attorney, Agent, or Firm*—Morgan, Lewis & Bockius LLP

(57) ABSTRACT

An antenna includes a first antenna element and a second antenna element. The first antenna element and the second antenna element are both configured to receive signals in a first band of frequencies and in a second band of frequencies. Frequencies in the second band of frequencies are greater than frequencies in the first band of frequencies. A first impedance matching circuit, coupled to the first antenna element, includes a first plurality of filters having a first shared component. A second impedance matching circuit, coupled to the second antenna element, includes a second plurality of filters having a second shared component. A feed network circuit is coupled to the first impedance matching circuit and to the second impedance matching circuit and has a combined output corresponding to the signals received by the first antenna element and a second antenna element.

23 Claims, 14 Drawing Sheets

ANTENNA WITH DUAL BAND LUMPED ELEMENT IMPEDANCE MATCHING

FIELD OF THE INVENTION

The present invention relates generally to multi-band antennas, and more specifically, to multi-band inverted-L antennas for use in global satellite positioning systems.

BACKGROUND OF THE INVENTION

Receivers in global navigation satellite systems (GNSS's), such as the Global Positioning System (GPS), use range measurements that are based on line-of-sight signals broadcast by satellites. The receivers measure the time-of-arrival of one or more of the broadcast signals. This time-of-arrival measurement includes a time measurement based upon a coarse acquisition coded portion of a signal, called pseudorange, and a phase measurement.

In GPS, signals broadcast by the satellites have frequencies that are in one or several frequency bands, including an L1 band (1565 to 1585 MHz), an L2 band (1217 to 1237 MHz), an L5 band (1164 to 1189 MHz) and L-band communications (1520 to 1560 MHz). Other GNSS's broadcast signals in similar frequency bands. In order to receive one or more of the broadcast signals, receivers in GNSS's often have multiple antennas corresponding to the frequency bands of the signals broadcast by the satellites. Multiple antennas, and the related front-end electronics, add to the complexity and expense of receivers in GNSS's. In addition, the use of multiple antennas that are physically displaced with respect to one another may degrade the accuracy of the range measurements, and thus the position fix, determined by the receiver. Further, in automotive, agricultural, and industrial applications it is desirable to have a compact, rugged navigation receiver. Such a compact and rugged receiver may be mounted inside or outside a vehicle, depending on the application.

There is a need, therefore, for improved compact antennas for use in receivers in GNSS's to address the problems associated with existing antennas.

SUMMARY

Embodiments of an antenna with dual band lumped element impedance matching are described. In some embodiments, the antenna includes a first antenna element and a second antenna element. The first antenna element and the second antenna element are both configured to receive signals in a first band of frequencies and in a second band of frequencies. Frequencies in the second band of frequencies are greater than frequencies in the first band of frequencies. A first impedance matching circuit is coupled to the first antenna element and includes a first plurality of filters having a first shared component. The first plurality of filters comprises a low pass filter and a high pass filter. In various embodiments of the antenna, the low pass filter and high pass filter are coupled in series, the first shared component includes an inductor, the first shared component further includes a capacitor, the first impedance matching circuit provides an impedance of substantially 50 Ohms, and/or the first antenna element and the second antenna element are arranged substantially along a first axis of the antenna.

In an embodiment the antenna includes a second impedance matching circuit coupled to the second antenna element, comprising a second plurality of filters having a second shared component. In some embodiments, the antenna further includes a feed network circuit coupled to the first impedance matching circuit and to the second impedance matching circuit and having a combined output corresponding to the signals received by the first antenna element and a second antenna element. In an embodiment, the first antenna element and the second antenna element each include a monopole situated above a ground plane, and the first shared component and the second shared component each include an inductor and a capacitor.

In an embodiment the first antenna element and the second antenna element each include a monopole situated above a ground plane. The first antenna element and the second antenna element are each inverted L-antennas. In an embodiment, the monopole is in a plane that is substantially parallel to a plane that includes the ground plane. In an embodiment, a portion of the monopole is also in a plane that is substantially perpendicular to a plane that includes the ground plane. The monopole includes a metal layer deposited on a printed circuit board. The printed circuit board may be suitable for microwave applications. In an embodiment, the first band of frequencies includes 1164 to 1237 MHz and the second band of frequencies includes 1520 to 1585 MHz.

In an embodiment, the antenna includes a third antenna element and a fourth antenna element, wherein the third antenna element and the fourth antenna element are both configured to receive signals in the first band of frequencies and in the second band of frequencies. The antenna includes a third impedance circuit coupled to the third antenna element, including a third plurality of filters having a third shared element. The antenna also includes a fourth impedance circuit coupled to the fourth antenna element, including a fourth plurality of filters having a fourth shared element.

In an embodiment, the first antenna element and the second antenna element are arranged substantially along a first axis of the antenna, and wherein the third antenna element and the fourth antenna element are arranged substantially along a second axis of the antenna. The first axis and the second axis are rotated by substantially 90° from one another.

In an embodiment, the antenna includes a feed network circuit coupled to the first antenna element, the second antenna element, the third antenna element and the fourth antenna element. The feed network circuit is configured to phase shift the received signals from the first antenna element, the second antenna element, the third antenna element and the fourth antenna element to preferentially receive radiation that is circularly polarized. In an embodiment, the feed network circuit is configured to phase shift the received signals from a respective antenna element relative to received signals from neighboring antenna elements in the antenna by substantially 90°. In an embodiment, the preferentially received radiation is right hand circularly polarized. In an alternate embodiment, the preferentially received radiation is left hand circularly polarized.

In an embodiment, an antenna includes a first radiation means and a second radiation means for receiving signals in a first band of frequencies and in a second band of frequencies, wherein frequencies in the second band of frequencies are greater than frequencies in the first band of frequencies. The first impedance matching means is coupled to the first radiation means, having a first filtering means. A second impedance matching means is coupled to the second radiation means, having a second filtering means.

In an embodiment, a method of processing signals includes filtering electrical signals coupled to a first antenna element and filtering electrical signals coupled to a second antenna element in an antenna. In an embodiment the method includes transforming the electrical signals such that an upper frequency band and a lower frequency band are passed. In an embodiment, the method includes transforming the electrical signals such that signals above an upper frequency band and below a lower frequency band are attenuated and a center frequency band is passed. In an embodiment, the method includes transforming the electrical signals such that an upper band and a lower band are passed and a center band is attenuated. The transforming includes providing a substantially similar impedance in two sub-bands of the center frequency band. In an embodiment, the substantially similar impedance in the two sub-bands is substantially 50 Ohms.

In an embodiment, a system includes an antenna, and an impedance matching circuit coupled to the antenna, wherein the impedance matching circuit includes a plurality of filters having a shared component. A feed network circuit is coupled to the impedance matching circuit. A low-noise amplifier is coupled to the feed network circuit. A sampling circuit is coupled to the low-noise amplifier.

BRIEF DESCRIPTION OF THE DRAWINGS

Additional objects and features of the invention will be more readily apparent from the following detailed description and appended claims when taken in conjunction with the drawings.

Like reference numerals refer to corresponding parts throughout the several views of the drawings.

DESCRIPTION OF EMBODIMENTS

Reference will now be made in detail to embodiments of the invention, examples of which are illustrated in the accompanying drawings. In the following detailed description, numerous specific details are set forth in order to provide a thorough understanding of the present invention. However, it will be apparent to one of ordinary skill in the art that the present invention may be practiced without these specific details. In other instances, well-known methods, procedures, components, and circuits have not been described in detail so as not to unnecessarily obscure aspects of the present invention.

The multi-band antenna covers a range of frequencies that may be too far apart to be covered using a single existing antenna. In an exemplary embodiment, the multi-band antenna is used to transmit or receive signal in the L1 band (1565 to 1585 MHz), the L2 band (1217 to 1237 MHz), the L5 band (1164 to 1189 MHz) and L-band communications (1520 to 1560 MHz). These four L-bands are treated as two distinct bands of frequencies: a first band of frequencies that ranges from approximately 1164 to 1237 MHz, and a second band of frequencies that ranges from approximately 1520 to 1585 MHz. Approximately center frequencies of these two bands are located at 1200 MHz ($f_1$) and 1552 MHz ($f_2$). These specific frequencies and frequency bands are only exemplary, and other frequencies and frequency bands may be used in other embodiments.

The multi-band antenna is also configured to have substantially constant impedance (sometimes called a common impedance) in the first and the second band of frequencies. These characteristics may allow receivers in GNSS's, such as GPS, to use fewer or even one antenna to receive signals in multiple frequency bands.

While embodiments of a multi-band antenna for GPS are used for as illustrative examples in the discussion that follows, it should be understood that the multi-band antenna may be applied in a variety of applications, including wireless communication, cellular telephony, as well as other GNSS's. The techniques described herein may be applied broadly to a variety of antenna types and designs for use in different ranges of frequencies.

Figure 1A:
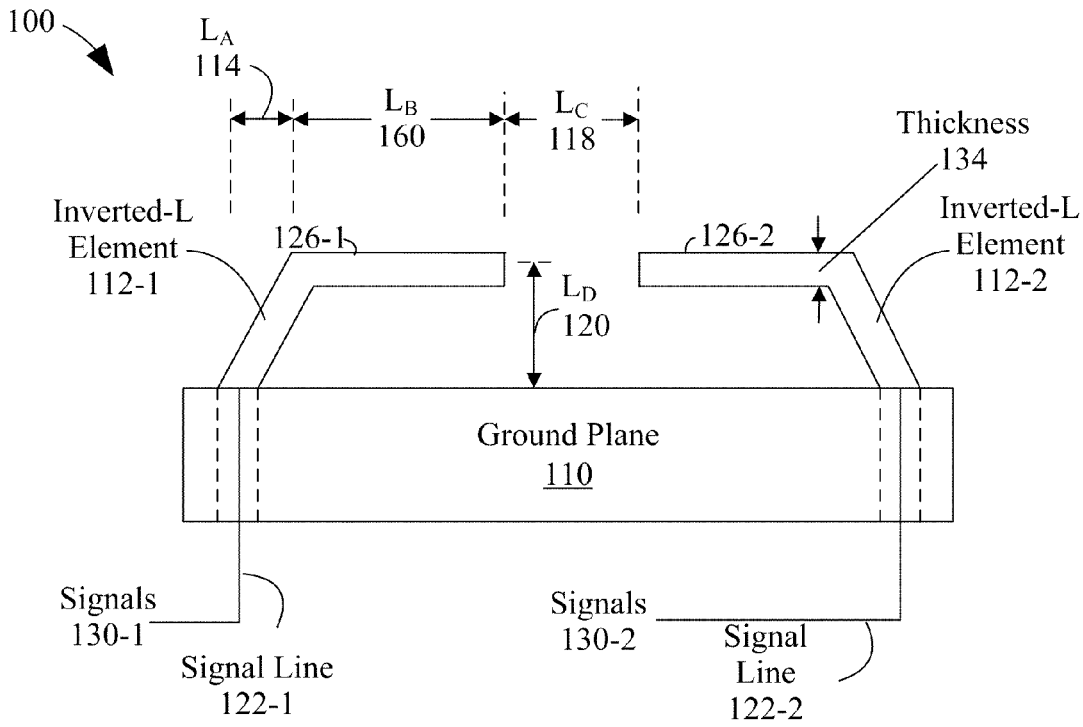
FIG. 1A is a block diagram illustrating a side view of an embodiment of an inverted-L multi-band antenna.
Figure 1B:
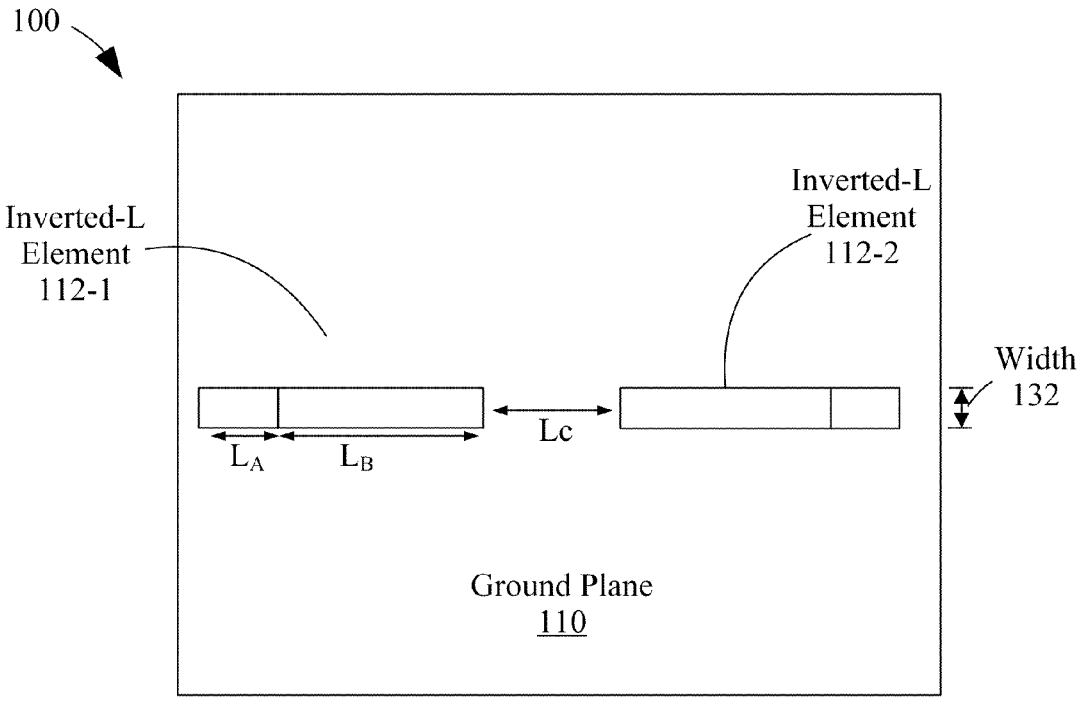
FIG. 1B is a block diagram illustrating a top view of an embodiment of an inverted-L multi-band antenna.

Attention is now directed towards embodiments of the multi-band antenna. FIGS. 1A and 1B are block diagrams illustrating side and top views of an embodiment of a multi-band antenna 100. The antenna 100 includes a ground plane 110 and two inverted-L elements 112. The inverted-L elements 112 are arranged approximately along a first axis of the antenna 100. Electrical signals 130 are coupled to and from the inverted-L elements using signal lines 122. In some embodiments, the signal lines 122 are coaxial cables and the ground plane 110 is a metal layer (e.g., in or on a printed circuit board) suitable for microwave applications. Referring to FIG. 1B, the inverted-L elements 112 has a length (when projected onto the ground plane 110) of $L_A+L_B$, where $L_A$ is the length (when projected onto the ground plane 110) of a vertical or tilted portion of a respective element 112 and $L_B$ is the length of a horizontal portion of the respective element 112.

Each of the inverted-L elements 112, such as inverted-L element 112-1, may have a monopole positioned above the ground plane 110. In the antenna 100, the monopole is in a plane that is approximately parallel to a plane that includes the ground plane 110. The monopole may be implemented using a metal layer deposited on a printed circuit board. The monopole has a length $L_A$+$L_B$ (114, 116), a width 132, a thickness 134, and may be a length $L_D$ 120 above the ground plane 110. The two inverted-L elements 112 may be separated by a distance $L_C$ 118. The inverted-L element 112-1 may have a tilted section that has a length projected along the ground plane 110 of $L_A$ 114. This tilted section may alter the radiation pattern of the antenna 100. It does not, however, significantly modify the electrical impedance characteristics of the antenna 100.

In some embodiments, the antenna 100 may include additional components or fewer components. Functions of two or more components may be combined. Positions of one or more components may be modified.

In other embodiments, the antenna 100 (FIGS. 1A and 1B) may include additional inverted-L elements. This is shown in FIGS. 2A and 2B.

Figure 2A:
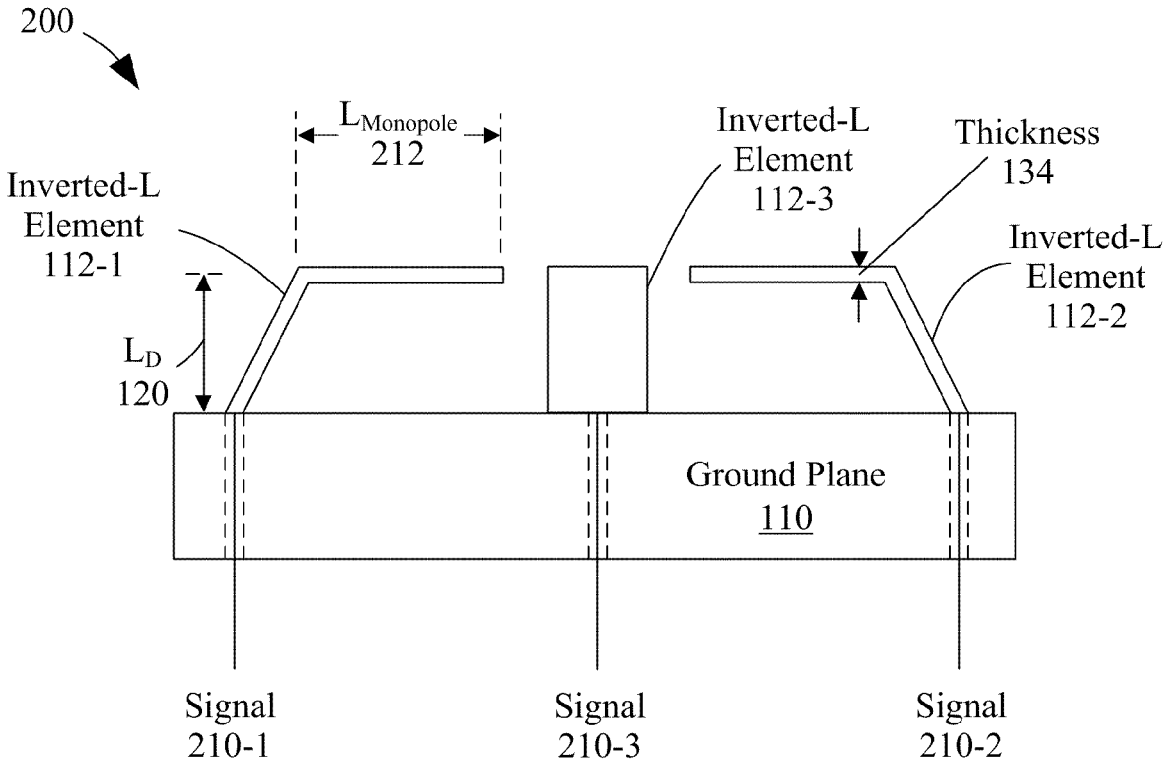
FIG. 2A is a block diagram illustrating a side view of an embodiment of a quad inverted-L multi-band antenna.
Figure 2B:
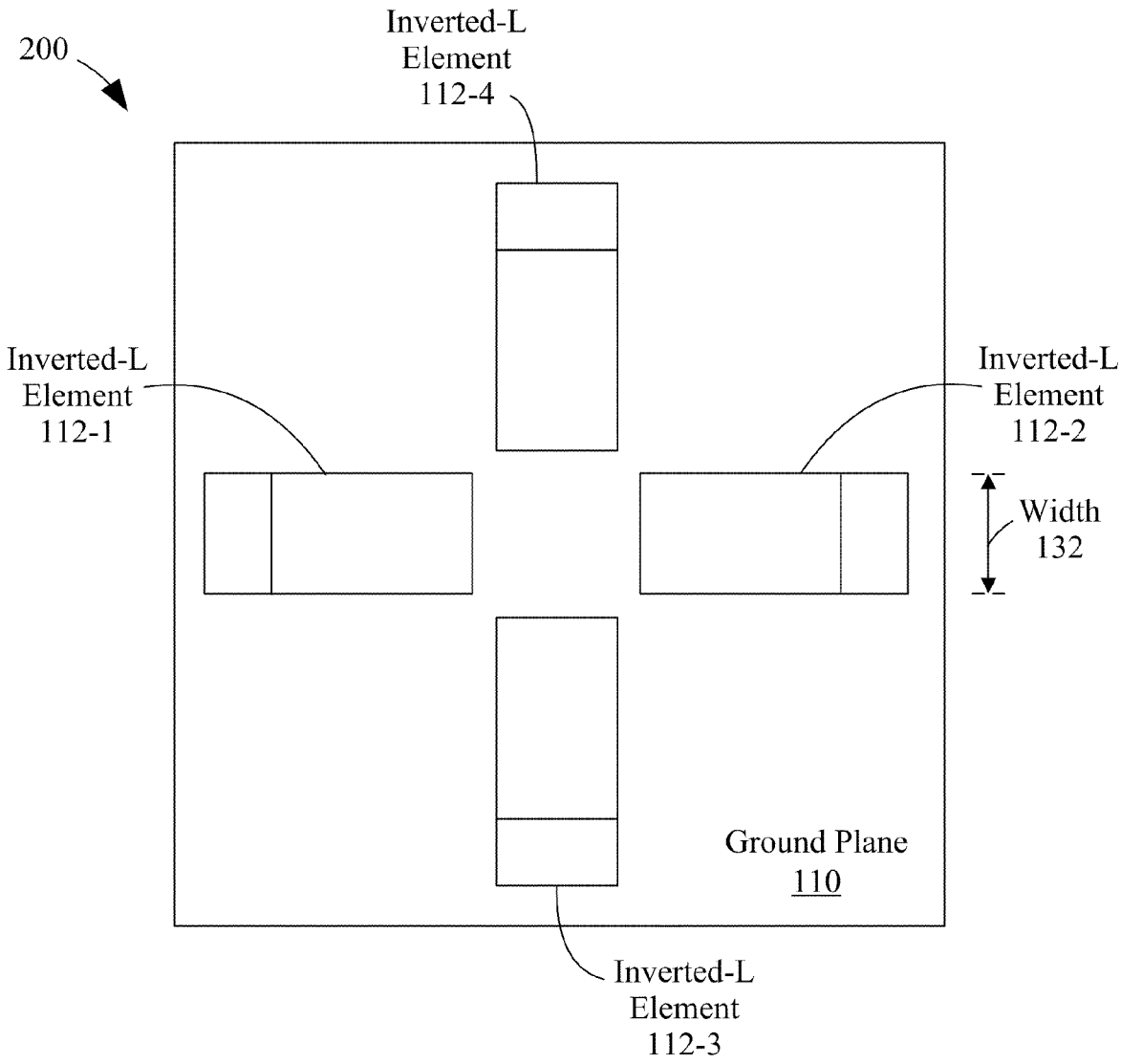
FIG. 2B is a block diagram illustrating a top view of an embodiment of a quad inverted-L multi-band antenna.

FIG. 2A is a block diagram illustrating a side view of an embodiment of quad inverted-L multi-band antenna 200. FIG. 2B is a block diagram illustrating top view of an embodiment of a quad inverted-L multi-band antenna 200. FIGS. 2A and 2B illustrate an embodiment of a multi-band antenna 200 having four inverted-L elements 112-1 through 112-4. FIG. 2A shows a side view (only three inverted-L elements are visible because of the side view, but four are present.) FIG. 2B shows a top view of antenna 200, with four inverted-L elements 112-1 through 112-4. Each inverted-L element has a width 132, and a thickness 134, and is situated a distance $L_D$ 120 over the ground plane 110. Inverted-L elements 112-1 and 112-2 are arranged approximately along the first axis of the antenna 200. Inverted-L elements 112-3 and 112-4 are arranged approximately along a second axis of the antenna 200. The second axis may be rotated by approximately 90° with respect to the first axis. Quad signals 210 are coupled to respective inverted-L elements 112.

Figure 2C:
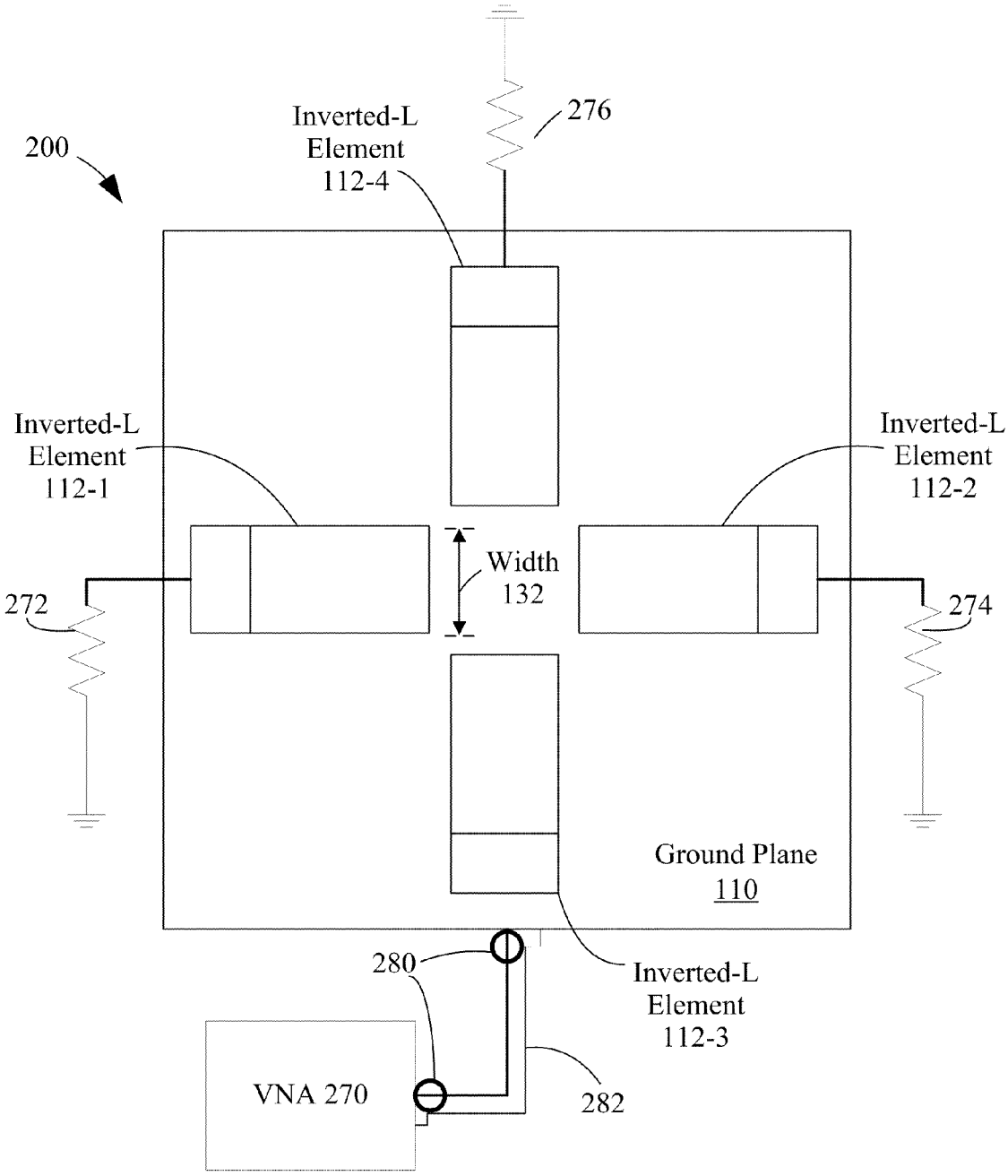
FIG. 2C is a block diagram illustrating testing of an embodiment of a quad inverted-L multi-band antenna, using a vector network analyzer.

FIG. 2C shows a block diagram illustrating testing of an embodiment of a quad inverted-L multi-band antenna, using a vector network analyzer 270. The inverted-L element under test (112-3) is connected via shielded cable 280 (with shield 282) to vector network analyzer 270. Each of the other inverted-L elements (112-1, 112-2, 112-4) are coupled to a respective resistor 272, 274, 276. In an embodiment, each of the resistors 272, 274, 276 is 50 Ohms, or approximately 50 Ohms.

Figure 3A:
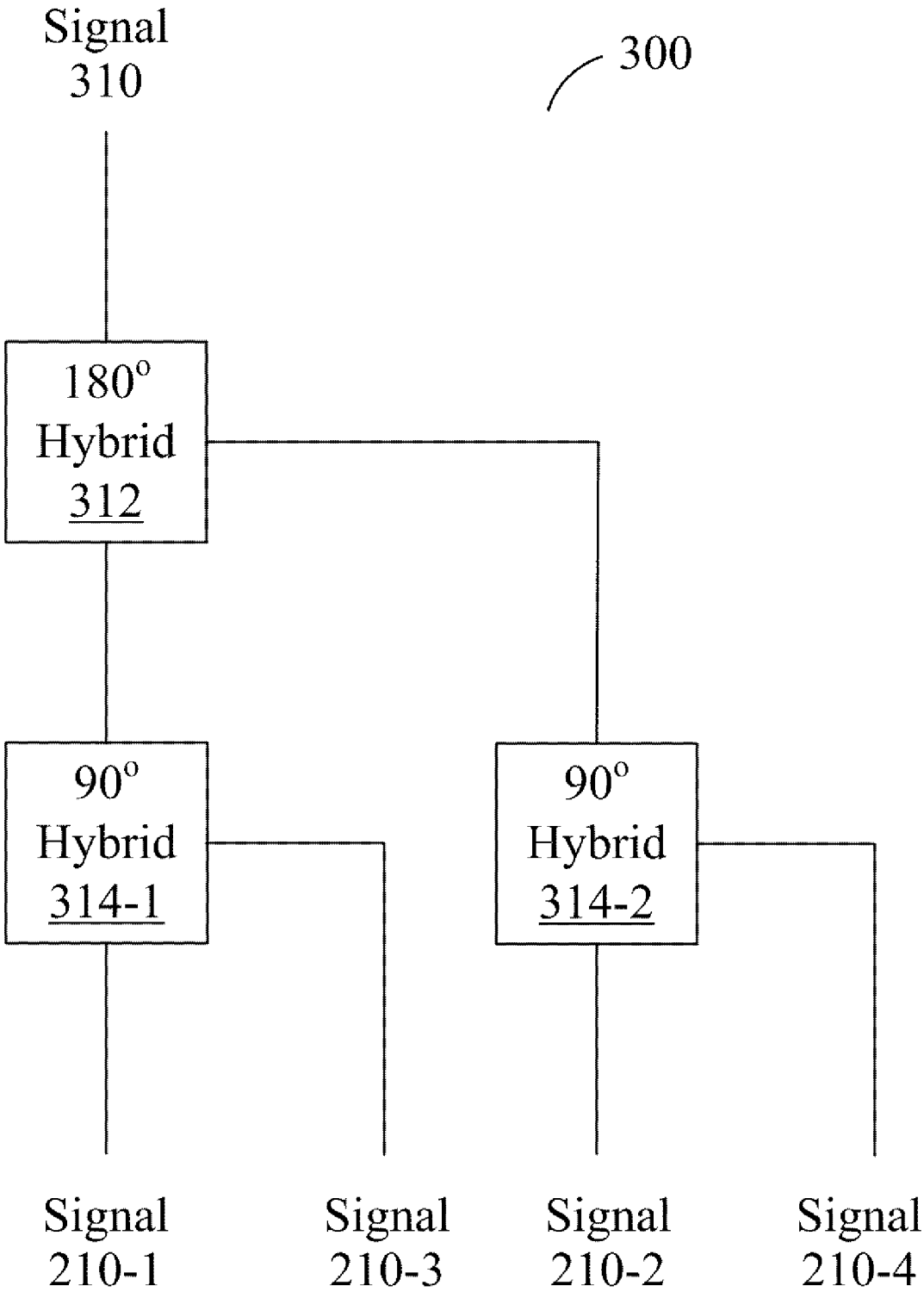
FIG. 3A is a block diagram illustrating an embodiment of a feed network circuit for a multi-band antenna.

FIG. 3A is a block diagram illustrating an embodiment of a feed network circuit 300 for a multi-band antenna. The feed network circuit 300 may be coupled to the quad antenna 200 (FIGS. 2A and 2B) to provide appropriately phased electrical signals 210 to the inverted-L elements 112.

In a transmit embodiment, a 180° hybrid circuit 312 accepts an input electrical signal 310 and outputs two electrical signals that are approximately 180° out of phase with respect to one another. Each of these electrical signals is coupled to one of the 90° hybrid circuits 314. Each 90° hybrid circuit 314 outputs two electrical signals 210. A respective electrical signal, such as electrical signal 310-1, may therefore have a phase shift of approximately 90° with respect to adjacent electrical signals 310. In this configuration, the feed network circuit 300 is referred to as a quadrature feed network. The phase configuration of the electrical signals 210 results in the antenna 200 (FIGS. 2A and 2B) having a circularly polarized radiation pattern. The radiation may be right hand circularly polarized (RHCP) or left hand circularly polarized (LHCP). Note that the closer the relative phase shifts of the electrical signals 210 are to 90° and the more evenly the amplitudes of the electrical signals 210 match each other, the better the axial ratio of the antenna 200 (FIGS. 2A and 2B) will be.

In a receive embodiment, the signals 210 are received by an antenna, and are combined through the feed network 300, resulting in signal 310 which is provided to a receive circuit for processing. Note, the receive embodiment is the same as the transmit embodiment, but signals are processed in the opposite direction (receive, instead of transmit) as described later.

Figure 3B:
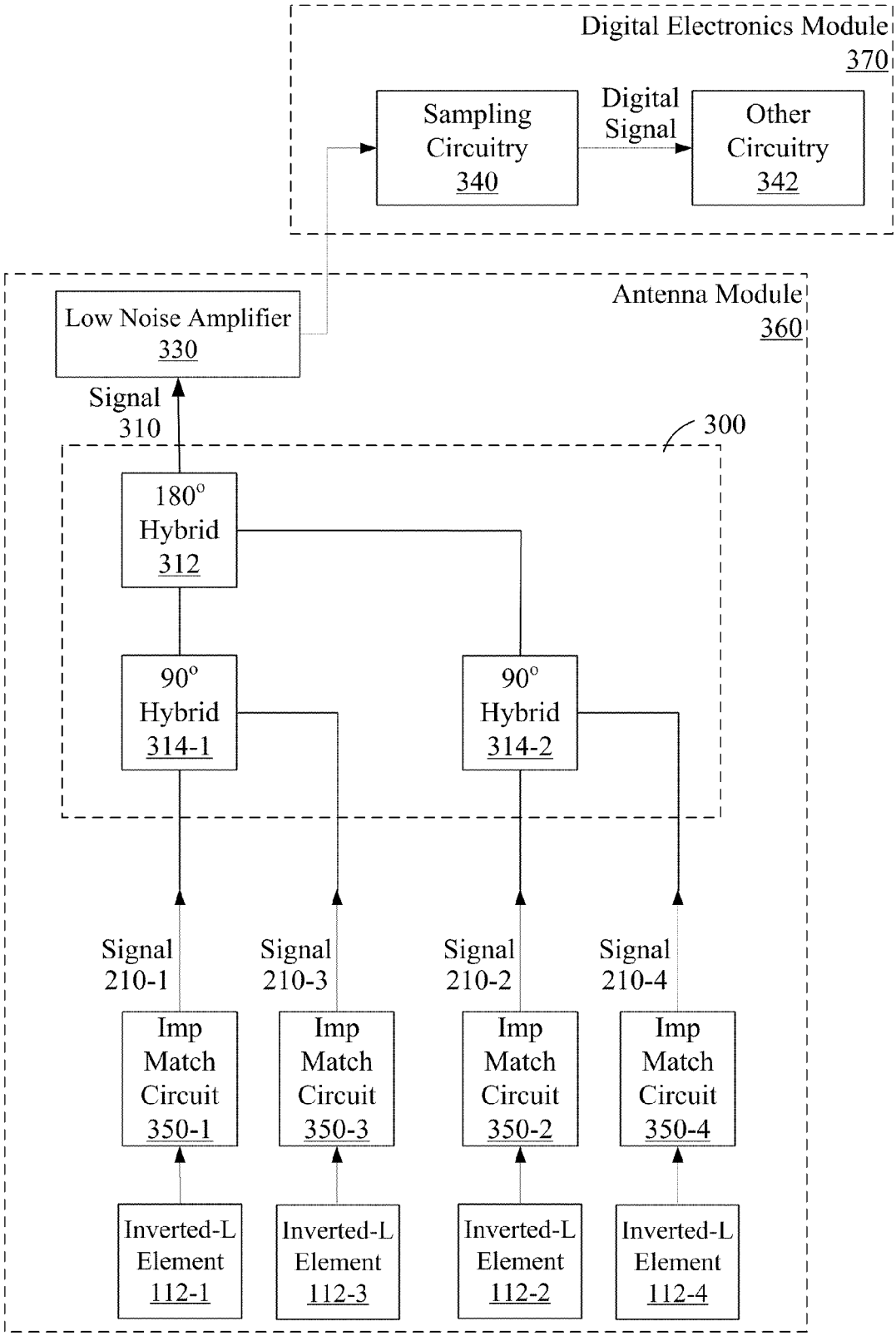
FIG. 3B is a block diagram illustrating a top view of an embodiment of a multi-band antenna system having a feed network, a low noise amplifier, and a digital electronics module.

FIG. 3B is a block diagram illustrating an embodiment of a multi-band antenna system having a feed network, a low noise amplifier, and a digital electronics module. FIG. 3B shows antenna module 360, comprising four inverted-L antenna elements 112 (112-1 through 112-4) coupled to four respective impedance matching circuits 350 (350-1 through 350-4, respectively). The impedance matching circuits 350 provides quad signals 210 to feed network 300 (as in FIG. 3A). The feed network 300 provides combined signal 310 to a low noise amplifier 330. The function of the low noise amplifier 330 is to amplify the weak received signals without introducing (or introducing only minimal or nominal) distortion or noise. The output of low noise amplifier 330 is coupled to digital electronics module 370, which includes sampling circuitry 340 and other circuitry 342. In an embodiment, circuitry 340 includes an analog to digital converter (ADC) and may include frequency translation circuitry such as downconverters. For example, circuitry 342 may include digital signal processing circuits, memory, a microprocessor, and one or more communication interfaces for conveying information to other devices. In an embodiment, the digital electronics module 370 processes a received signal to determine a location. In an embodiment, the antenna module 360 is on a single compact circuit board, and is packaged in a manner suitable for use in outdoor and harsh environments.

Figure 3C:
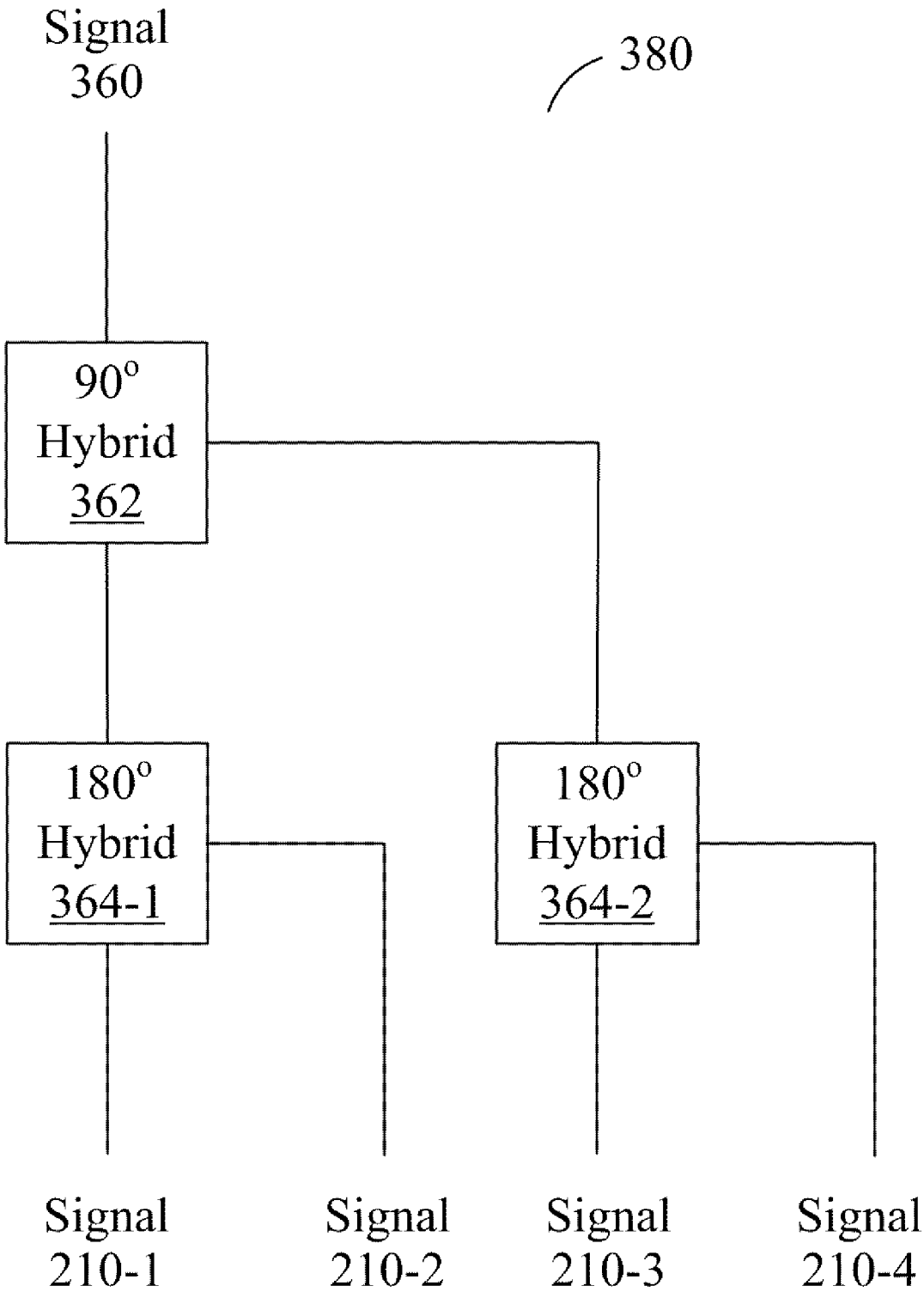
FIG. 3C is a block diagram illustrating an alternative embodiment of a feed network circuit for a multi-band antenna.

FIG. 3C is a block diagram illustrating an alternative embodiment 380 of a feed network circuit for a multi-band antenna. In the alternative embodiment 380, quad signals 210 (210-1 through 210-4) are coupled to a first set of 180° hybrid circuits (sometimes called phase shifters) 364. The 180° hybrid circuits are coupled to a 90° hybrid circuit (sometimes called a phase shifter) 362. The 90° hybrid circuit 362 is also coupled to a combined signal 360. As with feed network circuit 300, circuit 380 can be used in either a receive mode or transmit mode.

In some embodiments, the feed network circuit 300 or 380 may include additional components or fewer components. Functions of two or more components may be combined. Positions of one or more components may be modified.

Attention is now directed towards illustrative embodiments of the multi-band antenna and phase relationships that occur in the two or more frequency bands of interest. While the discussion focuses on the antenna 200 (FIGS. 2A and 2B), it should be understood that the approach may be applied to other antenna embodiments.

Referring to FIGS. 2A and 2B, the geometry of the inverted-L elements 112 may be determined based on a wavelength $\lambda$ (in vacuum) corresponding to the first band of frequencies, such as a central frequency $f_1$ of the first band of frequencies. (The wavelength $\lambda$ of the central frequency $f_1$ is equal to $c/f_1$, where c is the speed of light in vacuum.) In some embodiments, the inverted-L elements 112 are supported by printed circuit boards that are perpendicular to the ground plane 110. For example, the inverted L-elements 112 may be deposited on printed circuit boards that are mounted perpendicular to the ground plane 110, thereby implementing the geometry illustrated in FIGS. 1-2. In an exemplary embodiment, the printed circuit board material is 0.03 inch thick Rogers 4003, which is a printed circuit board material suitable for microwave applications (it has a low loss characteristic and its dielectric constant $\in$ of 3.38 is very consistent). Using FIGS. 1A, 1B, 2A, and 2B as an illustration, the length $L_D$ 120 is 0.08λ, the length $L_C$ 118 is 0.096λ, a length $L_B$ 160 is 0.152λ, the width 122 is 0.024λ, and the thickness 134 is 0.017 mm. For example, if the central frequency $f_1$ is 1200 MHz, the length $L_D$ 120 is approximately 20 mm, the length $L_C$ 118 is approximately 24 mm, a monopole length $L_{Monopole}$ 212 is approximately 38 mm, $L_C$ 118 is approximately 24 mm, and the width 122 is approximately 6 mm. (Note that $L_{Monopole}$ 212 equals $L_B$, in the embodiment 200.) In this exemplary embodiment, a central frequency $f_2$ in the second band of frequencies is approximately 5/4 (or somewhat more precisely 1.293) times a central frequency $f_1$ in the first band of frequencies.

In embodiments where the inverted L-elements are supported by printed circuit boards, the geometry of the inverted-L elements 112 and/or 212 are a function of the dielectric constant of the printed circuit board or substrate. Using FIGS. 2A and 2B as an illustrative example, for an antenna that operates at these frequencies and has a 0.03 inch thick substrate with a dielectric constant $\in$, $L_B$ 160, the length $L_D$ 120 and the width 122 can be expressed more generally as $$L_B=0.152\lambda(-0.015756\in+1.053256)$$

$$L_D=0.08\lambda(-0.015756\in+1.053256)$$

and $$\text{Width}=0.024\lambda(-0.015756\in+1.053256).$$

If a substrate with a lower dielectric constant $\in$ is used, the lengths of the inverted-L elements 112 and/or monopole 212 will be larger for a given central frequency $f_1$. Note that $L_C$ is approximately independent of $\in$.

Figure 4A:
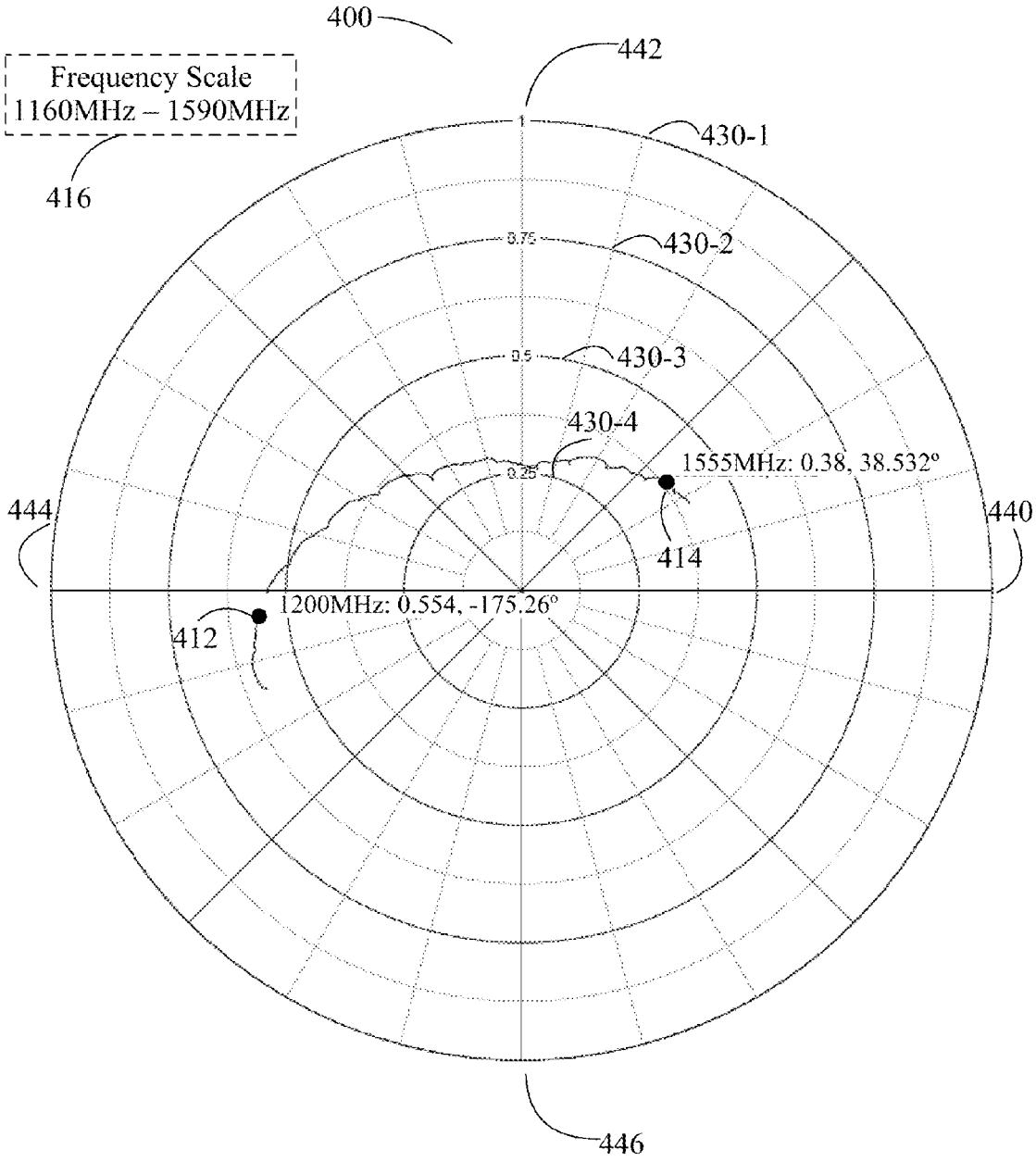
FIG. 4A depicts a graph showing simulated complex reflectance in polar coordinates as a function of frequency for one antenna element, without impedance compensation circuitry, in a multi-band antenna.

FIG. 4A is chart 400 that shows the simulated complex reflectance, in polar coordinates, of a single inverted-L antenna element 112-1, as a function of frequency from 1160 MHz to 1590 MHz. The complex reflectance is referenced to a terminal end of the inverted-L element 112-1, which may be located "at the bottom" of the element (when oriented as shown in FIG. 2A), just above or below the ground plane 110. The chart 400 is sometimes called a polar diagram or chart. Stated in another way, the chart 400 shows the portion (or more accurately, amplitude and phase shift) of an electrical signal that reaches the terminal end of the inverted-L element 112-1 that would be reflected back by the inverted-L element 112-1, as a function of the frequency of the electrical signal.

The circles 430 (marked 0.25, 0.5, 0.75, 1) represent the portion of amplitude (and hence, energy) of an electrical signal that would be reflected back by the inverted-L antenna element if the graph of the antenna element's reflectance were to reach or cross those circles. At the outermost circuit 430-1 (1), one hundred percent (100% ) of the amplitude of an electrical signal is reflected back from the antenna element. At the innermost circle 430-4 (0.25), twenty-five percent (25%) of the amplitude of a signal coupled to the antenna element is reflected. For a well-matched antenna, the reflected amplitude will be minimized (e.g., thirty percent or less for all frequencies at which the antenna is intended to operate). The radii coming from the center of the circle represent phase shift of the signal reflected back from the inverted-L antenna element. At the right most position 440 (three o'clock on the circle), the reflected signal has no phase shift. At the top position 442 (twelve o'clock on the circle) the reflected signal has +90 degrees phase shift. At the left most position 444 (nine o'clock on the circle) the reflected signal has +/−180 degrees phase shift. At the bottom position 446 (six o'clock on the circle) the reflected signal has −90 degrees phase shift.

As noted above, the chart 400 in FIG. 4A shows a simulated complex reflectance for an inverted-L antenna element 112-1 without any impedance matching. Points of particular interest are point 412 and point 414. Point 412 shows the resistance and reactance of an unmatched inverted-L element at a first frequency (1200 MHz approximately). For the first frequency, over fifty percent (50%) of signal amplitude is reflected back from the unmatched antenna, with a phase shift of approximately 180 degrees. Point 414 shows the resistance and reactance of an unmatched inverted-L element at a second frequency (1555 MHz approximately). For the second frequency, approximately thirty percent (30%) of signal amplitude is reflected back from the unmatched antenna, with a phase shift of approximately 45 degrees.

Figure 4B:
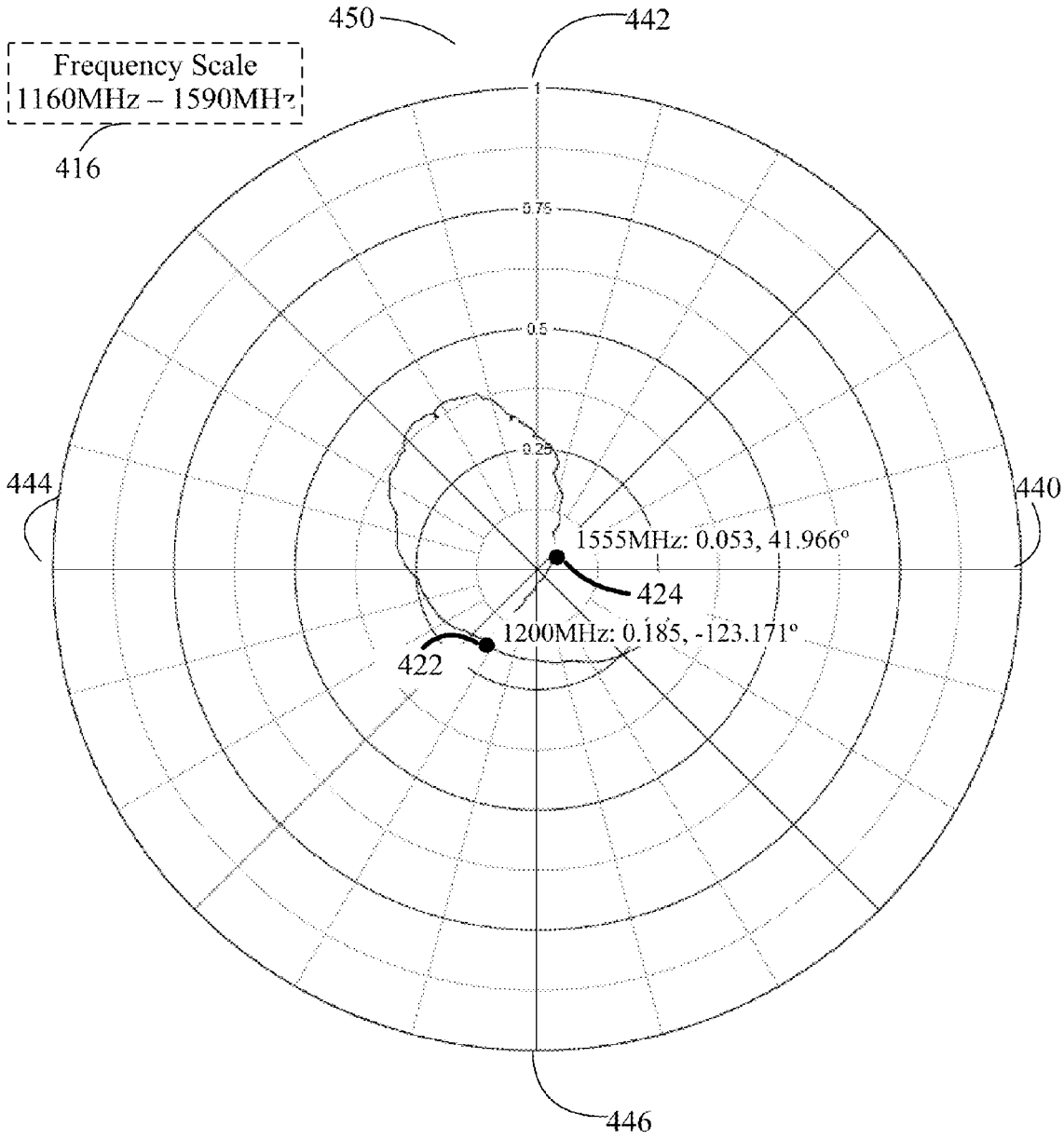
FIG. 4B depicts a graph showing simulated complex reflectance in polar coordinates as a function of frequency for one antenna element, coupled to a lumped element impedance matching circuit, in a multi-band antenna, in accordance with some embodiments.

FIG. 4B is a chart 450 showing the simulated complex reflectance for an embodiment of an inverted-L antenna 112-1 with a lumped element impedance matching circuit, which will be described in more detail below. The structure of chart 450 is the same as that of chart 400. Note that on chart 450, point 422 shows the resistance and reactance of an impedance-matched (or impedance compensated) inverted-L element at the first frequency (1200 MHz approximately). Point 424 shows the resistance and reactance of an impedance-matched (or impedance compensated) inverted-L element at the second frequency (1555 MHz approximately). As can be seen from chart 450, for the matched antenna elements, the points 422 and 424 are much closer to the center of the circle than the corresponding points 412 and 414 in FIG. 4A, indicating lower reflectance, and thus more efficient energy transfer to and from the antenna element to which the impedance matching circuit is coupled.

Figure 5A:
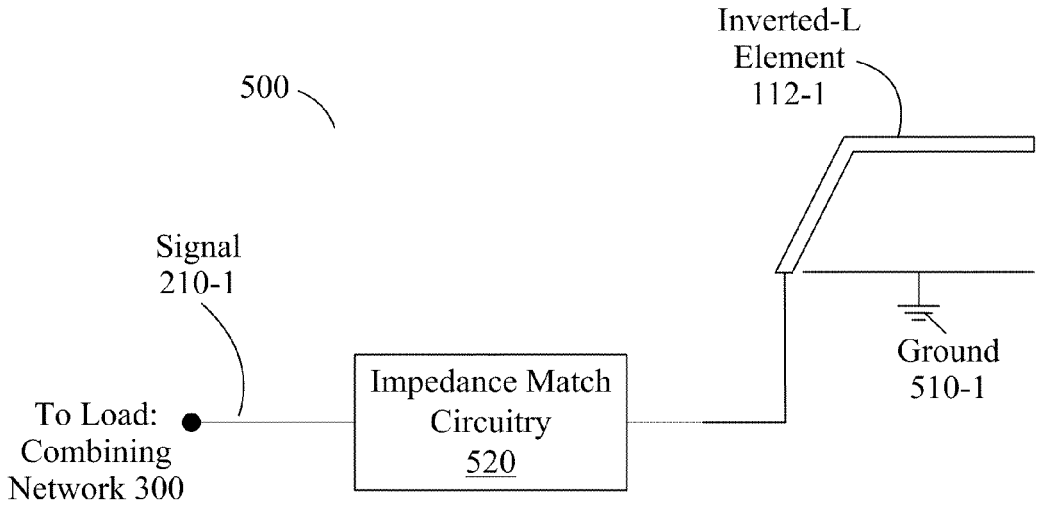
FIG. 5A is a block diagram of an embodiment of an impedance matching circuit having a shared element, for a multi-band antenna.

FIG. 5A is a block diagram 500 of an embodiment of an impedance matching circuit 520 having a shared element, for a multi-band antenna. The impedance matching circuit 520 is coupled to a combining network 300, and to inverted-L element 112, situated over ground plane 510. The impedance matching circuit 520 "matches" the impedance (or more accurately, reduces impedance mismatch) between the antenna element 112 and the load (combining network 300) to minimize reflections and maximize energy transfer. Signal 210 is coupled between the combining network 300 and the impedance matching circuitry 520.

Figure 5B:
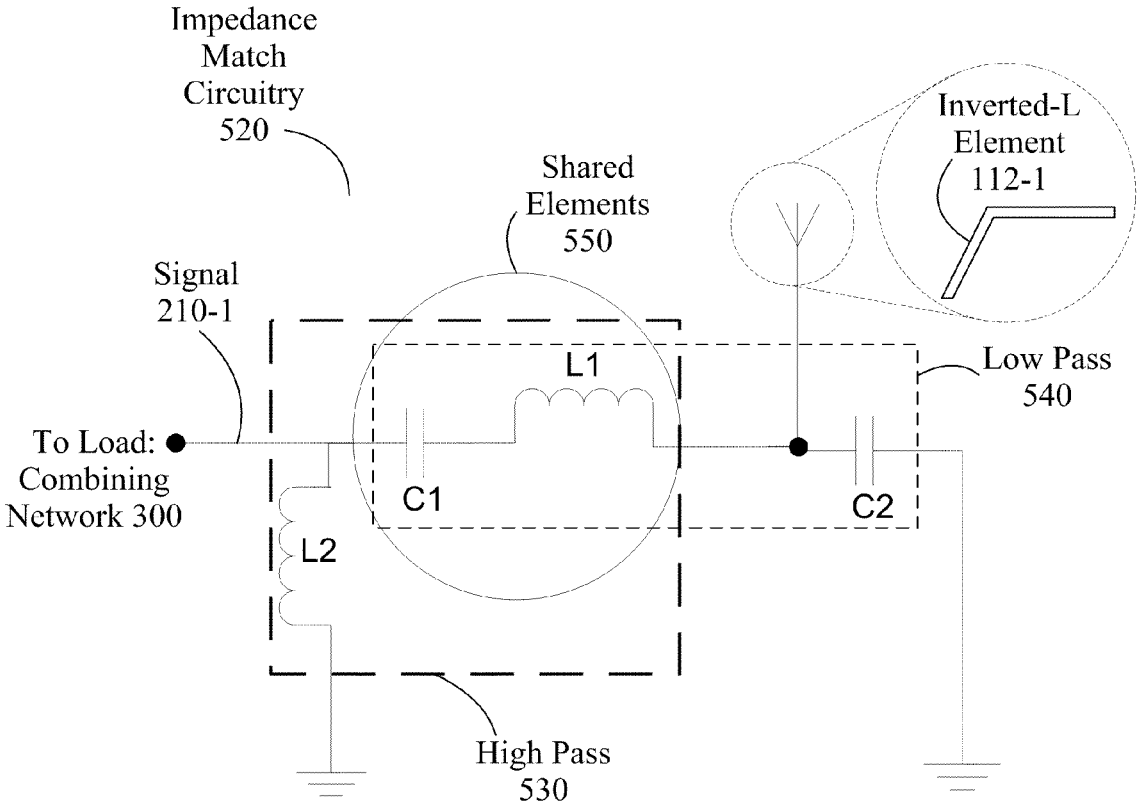
FIG. 5B is a circuit diagram of an impedance matching circuit having a plurality of filters with shared elements.

FIG. 5B is a circuit diagram of an embodiment of impedance matching circuit 520 having a plurality of filters with shared elements for a multi-band antenna. In this embodiment, the impedance matching circuit 520 comprises a high pass filter 530 coupled in series with a low pass filter 540. The high pass filter 530 comprises a parallel inductor (L2) to ground, and a capacitor (C1) and inductor (L1) connected in series. The low pass filter 540 comprises a capacitor (C2) to ground, and the capacitor (C1) and inductor (L1) connected in series. Thus, the high pass filter 530 and low pass filter 540 have shared elements 550, namely the series capacitor (C1) and inductor (L1). Signal 210 is coupled between the load, combining network 300, and the parallel L2 inductor and series C1 capacitor of impedance match circuitry 520. In one embodiment, for which the graphs in FIGS. 4B and 6 were generated by simulation, the sizes of the elements in circuit 520 are as follows: capacitor C1: 1.8 pF, inductor L1: 6.2 nH, capacitor C2: 2.2 pF, and inductor L2: 3.9 nH. Of course, many other sets of component values may be used in other embodiments.

Figure 6:
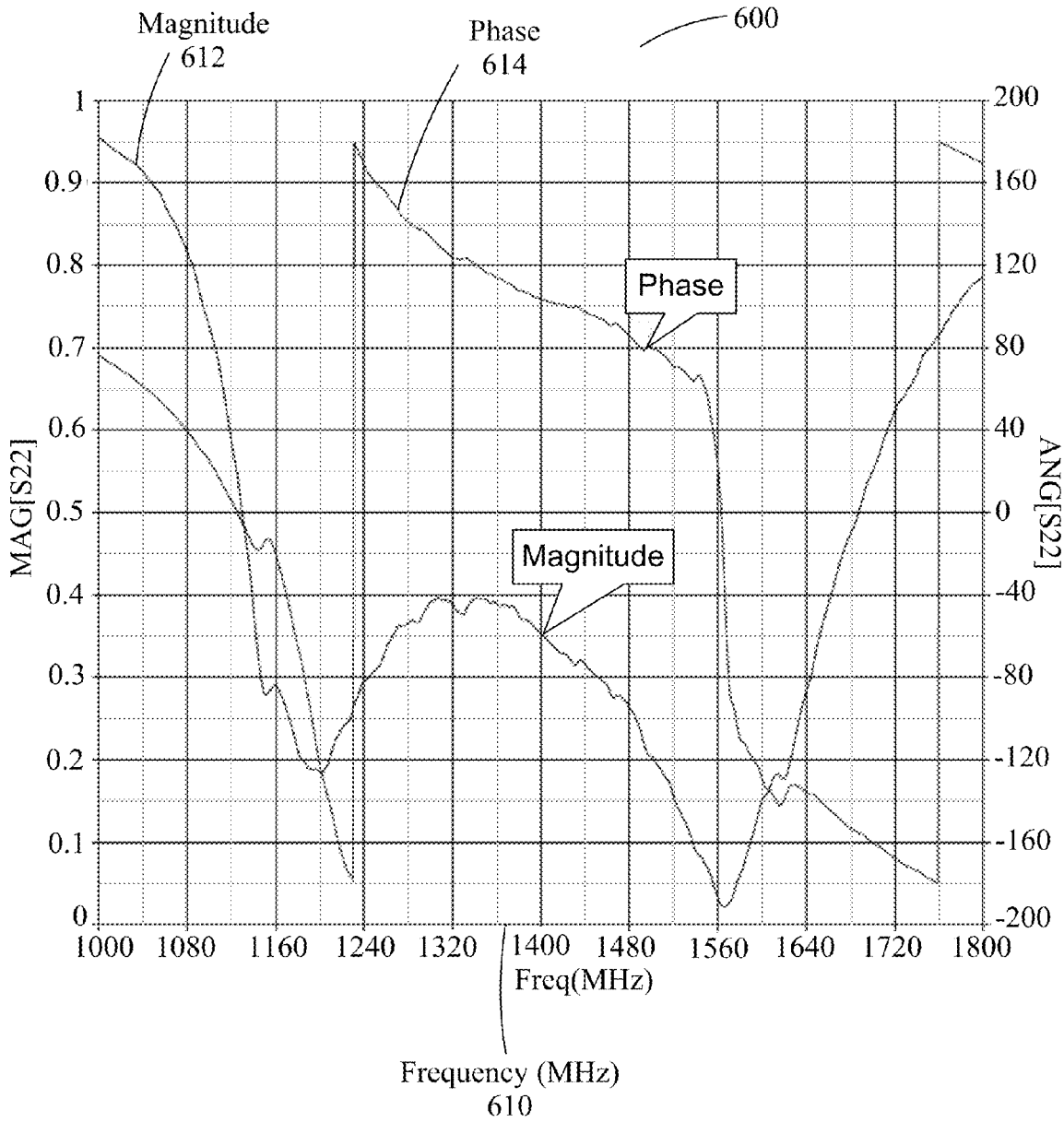
FIG. 6 is a graph showing simulated magnitude and phase versus frequency of complex reflectance for an embodiment of an antenna element coupled to an impedance matching circuit having a shared element.

FIG. 6 illustrates a graph 600 of simulated magnitude 612 and phase 614 of complex reflectance versus frequency 610 for an embodiment of an inverted-L antenna element coupled to an impedance matching circuit (e.g., the impedance matching circuit 520 shown in FIG. 5), for a multi-band antenna. In the graph 600, in the frequency bands of interest, the magnitude of the complex reflectance is less than a threshold amount (e.g., thirty percent of the amplitude of a signal coupled to the antenna element by the impedance matching circuit). The antenna element, such as an antenna element of antenna 200 (FIGS. 2A and 2B), exhibits low return loss or good matching (as evidenced by low reflectance magnitude 612) in the vicinity of 1200 MHz and 1552 MHz. As described below with reference to FIG. 7, these frequencies correspond to the center frequencies of a first frequency band and a second frequency band. This indicates that the antenna design is able to support at least dual band operation. In other embodiments, three or more bands may be supported. The graph 600 of FIG. 6 shows similar data to chart 450 of FIG. 4B, but in a different format.

Figure 7:
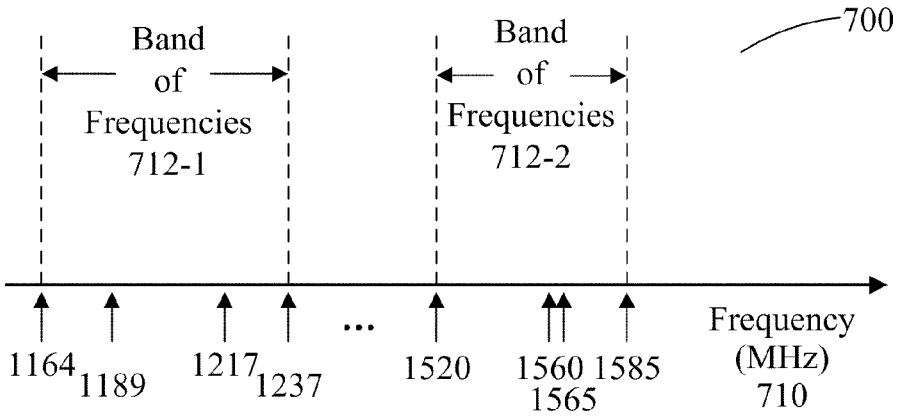
FIG. 7 shows bands of frequencies corresponding to a global satellite navigation system.

FIG. 7 is a diagram 700 showing bands 712 of frequencies corresponding to a global satellite navigation system, including the L1 band (1565 to 1585 MHz), the L2 band (1217 to 1237 MHz), the L5 band (1164 to 1189 MHz) and the L-band (1520 to 1560 MHz). Frequency 710 is shown on the x-axis. In the exemplary embodiment of the multi-band antenna described above, a first band of frequencies 712-1 includes 1164-1237 MHz and a second band of frequencies 712-2 includes 1520-1585 MHz. Note that even though 1200 and 1552 MHz are not precisely equal to the central frequencies (also called the band center frequencies) of these bands, they are close enough to the band center frequencies to achieve the desired antenna properties. In an embodiment, the center frequencies are actually at 1200.5 MHz and 1552.5 MHz. The multi-band antenna has low return loss (e.g., less than thirty percent) in both the first band of frequencies 712-1 and the second band of frequencies 712-2. In addition, the first band of frequencies 712-1 encompasses the L2 and L5 bands, and the second band of frequencies 712-2 encompasses the L1 band and L-band. Thus, a single multi-band antenna is able to transmit and/or receive signals in these four GPS bands.

Figure 8:
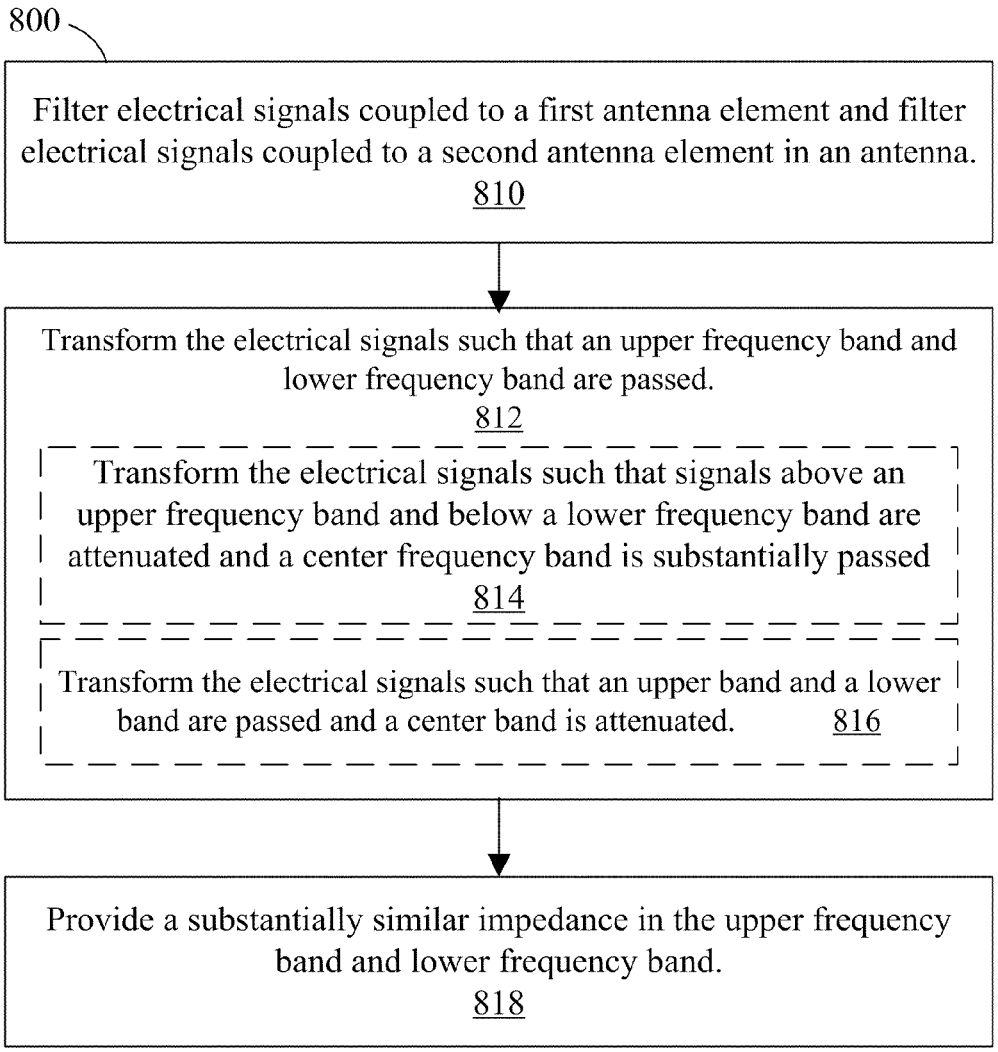
FIG. 8 is a flow chart illustrating an embodiment of a method of using a lumped element impedance matching circuit for a multi-band antenna

Attention is now directed towards embodiments of processes of using a multi-band antenna with lumped element impedance matching. FIG. 8 is a flow chart illustrating an method 800 of using a multi-band antenna. The method includes filtering electrical signals coupled to a first antenna element and filtering electrical signals coupled to a second antenna element in an antenna (810). The method includes transforming the electrical signals such that an upper frequency band and a lower frequency band are passed (812). In an embodiment the method includes transforming the electrical signals such that signals above an upper frequency band and below a lower frequency band are attenuated and a center frequency band is substantially passed (814). In an embodiment, the method includes transforming the electrical signals such that an upper band and a lower band are passed and a center band is attenuated (816). In an embodiment, the method provides a substantially similar impedance in two sub-bands of the center frequency band (818).

In some embodiments, the method 800 of using a multi-band antenna may include fewer or additional operations. An order of the operations may be changed. At least two operations may be combined into a single operation.

Figure 9:
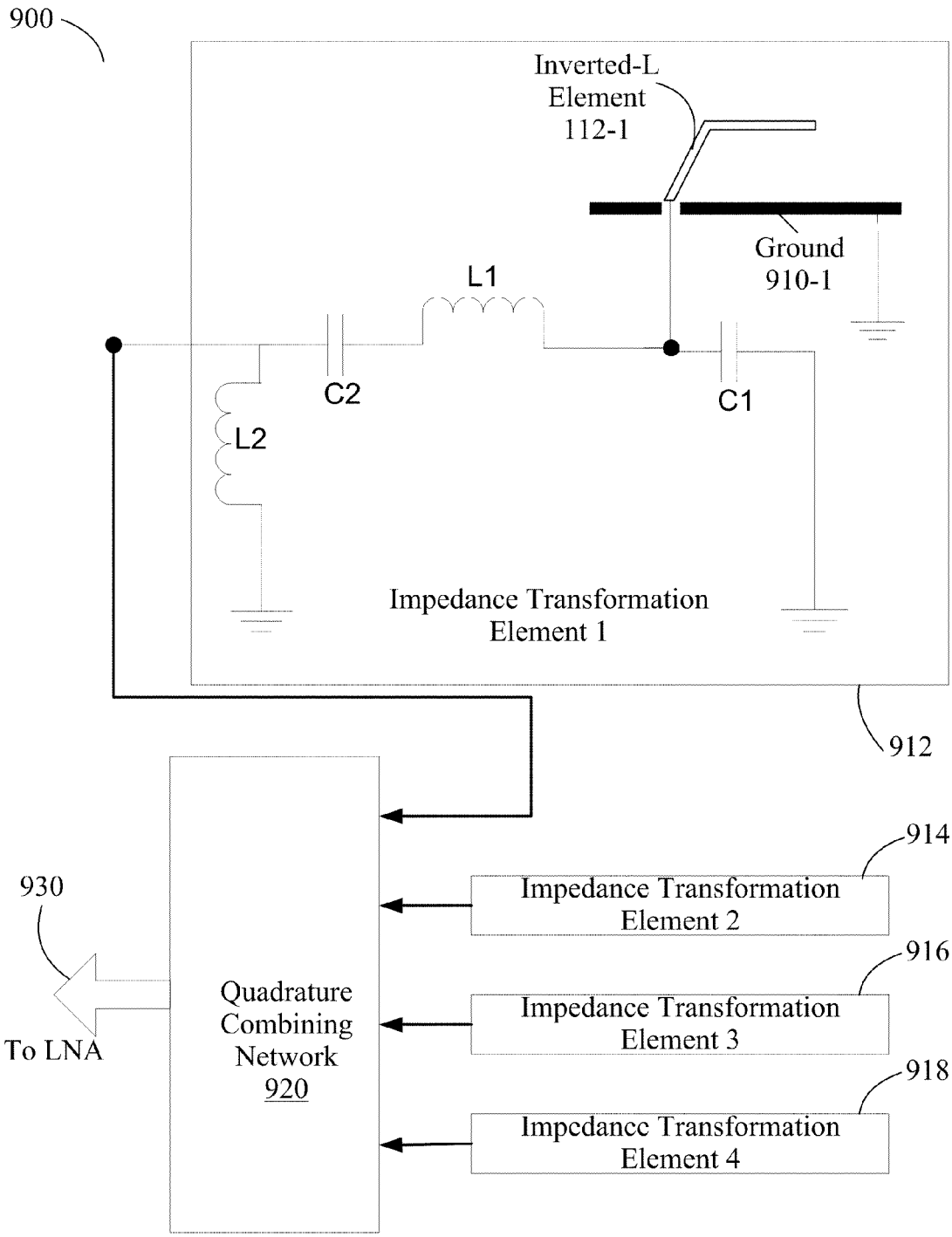
FIG. 9 is mixed block and circuit diagram of an embodiment of a system having a quad multi-band inverted-L antenna including lumped element impedance matching circuits, with a combining network and a low noise amplifier.

FIG. 9 depicts a system 900 having a quad multi-band inverted-L antenna including lumped element impedance matching circuits, with a combining network and a low noise amplifier. In a first impedance transformation element 912, a first inverted-L element 112-1 is coupled to an impedance matching circuit (as in FIG. 5). An output of the impedance transformation element 912 is coupled to a quadrature combining network 920. The quadrature combining network 920 is coupled to a low noise amplifier (LNA) 930. Similarly second (914), third (916), and fourth (918) impedance transformation elements each comprise an inverted-L antenna element coupled to an impedance matching circuit, and are coupled to the quadrature combining network 920. In an embodiment, the system 900 is implemented using lumped element impedance matching circuits. In an embodiment, the system 900 is implemented on a single compact circuit board having a diameter of about six inches. In an embodiment, such a circuit board provides a desirable gain pattern for GPS reception. By making the diameter larger or smaller, one may alter the gain pattern to provide more gain at lower elevations and less at high elevations or vice versa. The exact effect will vary with frequency. In a particular implementation, the antenna element impedance characteristics were found to be very weak functions of the circuit board (and hence the ground plane) diameter. In an embodiment, the system 900 is implemented on a compact circuit board having a diameter of between approximately three inches and six inches. In an embodiment, the system 900 is implemented on a compact circuit board having a diameter of between approximately five inches and seven inches. In an embodiment, the system 900 is implemented on a compact circuit board having a diameter of between approximately three inches and eight inches. In an embodiment, the system 900 is implemented on a compact circuit board having a diameter of between approximately two inches nine inches. In an embodiment, the system 900 is implemented on a compact circuit board having a diameter between approximately one inch and twelve inches. Embodiments with a compact circuit board having a diameter of less than three inches (e.g., between approximately 1 inch and three inches in diameter) may be used with smaller inverted-L elements than would be appropriate for the frequency bands discussed above, and thus would be appropriate for receiving and/or transmitting in higher frequency bands than the frequency bands discussed above. An example of sizing the inverted-L elements as a function of the wavelength of the center frequency of a band of frequencies to be received or transmitted is discussed above.

Figure 10A:
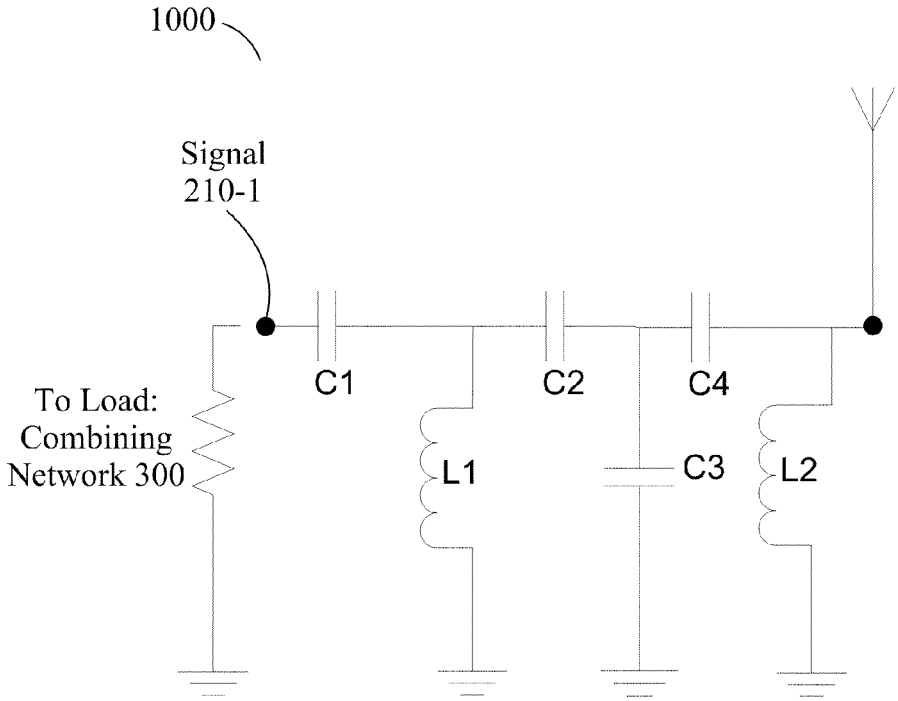
FIGS. 10A and 10B show alternative embodiments of an impedance matching circuit.
Figure 10B:
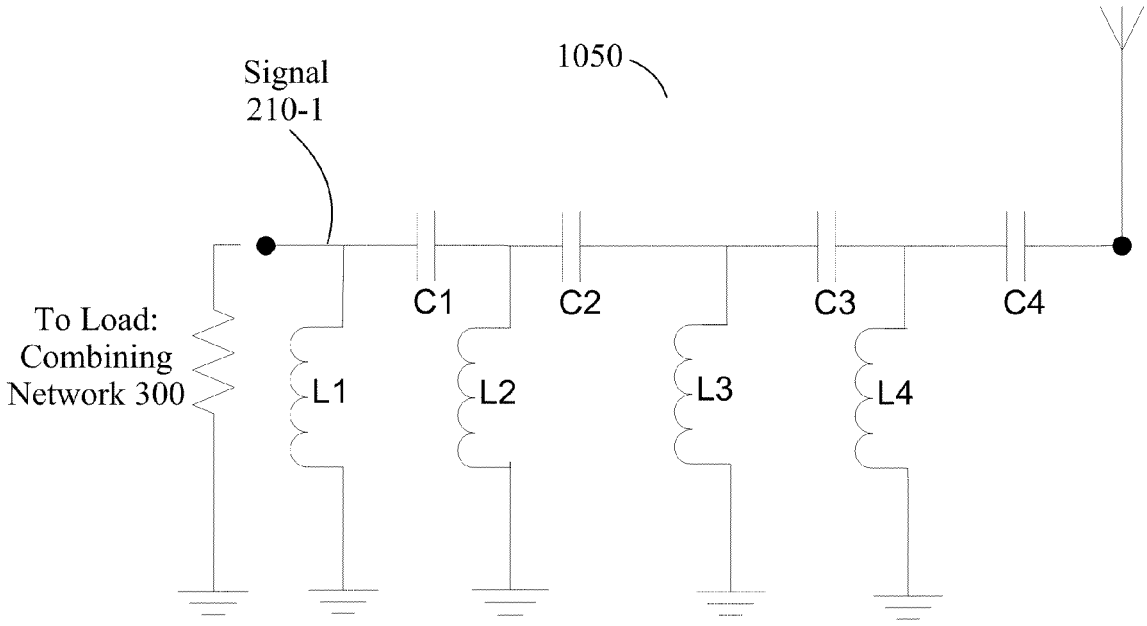

FIGS. 10A and 10 shows alternative embodiments of an impedance matching circuit. FIG. 10A shows a circuit 1000 for a six-pole shared-element impedance matching circuit. FIG. 10B shows a circuit 1050 for an eight-pole shared-element impedance matching circuit. In some embodiments, the impedance matching circuits described may include fewer or additional elements or poles. An order of the elements may be changed. At least two elements may be combined into a single element.

The foregoing description, for purposes of explanation, used specific nomenclature to provide a thorough understanding of the invention. However, it will be apparent to one skilled in the art that the specific details are not required in order to practice the invention. The embodiments were chosen and described in order to best explain the principles of the invention and its practical applications, to thereby enable others skilled in the art to best utilize the invention and various embodiments with various modifications as are suited to the particular use contemplated. Thus, the foregoing disclosure is not intended to be exhaustive or to limit the invention to the precise forms disclosed. Many modifications and variations are possible in view of the above teachings.

It is intended that the scope of the invention be defined by the following claims and their equivalents.

What is claimed:

1. An antenna, comprising:

a first antenna element and a second antenna element, wherein the first antenna element and the second antenna element are both configured to receive signals in a first band of frequencies and in a second band of frequencies, and wherein frequencies in the second band of frequencies are greater than frequencies in the first band of frequencies; and a first impedance matching circuit, coupled to the first antenna element, comprising a first plurality of filters having a first shared component.

2. The antenna of claim 1, wherein the first plurality of filters comprises a low pass filter and a high pass filter.

3. The antenna of claim 2, wherein the low pass filter and high pass filter are coupled in series and the first shared component is shared by the low pass filter and the high pass filter.

4. The antenna of claim 3, wherein the first shared component comprises an inductor.

5. The antenna of claim 4, wherein the first shared component further comprises a capacitor.

6. The antenna of claim 1, wherein the first impedance matching circuit provides an impedance of substantially 50 Ohms.

7. The antenna of claim 1, wherein the first antenna element and the second antenna element each include a monopole situated above a ground plane.

8. The antenna of claim 7, wherein the first antenna element and the second antenna element are each inverted L-antennas.

9. The antenna of claim 7, wherein the monopole is in a plane that is substantially parallel to a plane that includes the ground plane.

10. The antenna of claim 7 wherein the monopole is in a plane that is substantially perpendicular to a plane that includes the ground plane.

11. The antenna of claim 7, wherein the monopole includes a metal layer deposited on a printed circuit board, and wherein the printed circuit board is suitable for microwave applications.

12. The antenna of claim 1, wherein the first band of frequencies includes 1164 to 1237 MHz and the second band of frequencies includes 1520 to 1585 MHz.

13. The antenna of claim 1, wherein the first antenna element and the second antenna element are arranged substantially along a first axis of the antenna.

14. The antenna of claim 1, wherein the first plurality of filters provide impedance matching for at least two distinct frequency bands concurrently.

15. An antenna, comprising:

a first antenna element and a second antenna element, wherein the first antenna element and the second antenna element are both configured to receive signals in a first band of frequencies and in a second band of frequencies, and wherein frequencies in the second band of frequencies are greater than frequencies in the first band of frequencies;

a first impedance matching circuit, coupled to the first antenna element, comprising a first plurality of filters having a first shared component;

a second impedance matching circuit coupled to the second antenna element, comprising a second plurality of filters having a second shared component; and a feed network circuit coupled to the first impedance matching circuit and to the second impedance matching circuit and having a combined output corresponding to the signals received by the first antenna element and a second antenna element.

16. The antenna of claim 15, wherein the first antenna element and the second antenna element each include a monopole situated above a ground plane, and wherein the first shared component and the second shared component each include an inductor and a capacitor.

17. An antenna, comprising:

a first antenna element and a second antenna element, wherein the first antenna element and the second antenna element are both configured to receive signals in a first band of frequencies and in a second band of frequencies, and wherein frequencies in the second band of frequencies are greater than frequencies in the first band of frequencies;

a first impedance matching circuit, coupled to the first antenna element, comprising a first plurality of filters having a first shared component;

a third antenna element and a fourth antenna element, wherein the third antenna element and the fourth antenna element are configured to receive signals in the first band of frequencies and in the second band of frequencies;

a third impedance circuit coupled to the third antenna element, comprising a third plurality of filters having a third shared element; and a fourth impedance circuit coupled to the fourth antenna element, comprising a fourth plurality of filters having a fourth shared element.

18. The antenna of claim 17, wherein the first antenna element and the second antenna element are arranged substantially along a first axis of the antenna, and wherein the third antenna element and the fourth antenna element are arranged substantially along a second axis of the antenna.

19. The antenna of claim 18, wherein the first axis and the second axis are rotated by substantially 90° from one another.

20. The antenna of claim 19, further comprising a feed network circuit coupled to the first antenna element, the second antenna element, the third antenna element and the fourth antenna element, wherein the feed network circuit is configured to phase shift the received signals from the first antenna element, the second antenna element, the third antenna element and the fourth antenna element to preferentially receive radiation that is circularly polarized.

21. The antenna of claim 20, wherein the feed network circuit is configured to phase shift the received signals from a respective antenna element relative to received signals from neighboring antenna elements in the antenna by substantially 90°.

22. The antenna of claim 21, wherein the preferentially received radiation is right hand circularly polarized.

23. A system, comprising:

an antenna;

an impedance matching circuit coupled to the antenna, wherein the impedance matching circuit comprises a plurality of filters having a shared component;

a feed network circuit coupled to the impedance matching circuit;

a low-noise amplifier coupled to the feed network circuit; and a sampling circuit coupled to the low-noise amplifier.

* * * * *